US008783832B2

(12) United States Patent
Oonuki et al.

(10) Patent No.: US 8,783,832 B2
(45) Date of Patent: Jul. 22, 2014

(54) INK JET PRINTING APPARATUS AND METHOD FOR CONTROLLING INK JET PRINTING APPARATUS

(71) Applicant: Canon Kabushiki Kaisha, Tokyo (JP)

(72) Inventors: Kenichi Oonuki, Tokyo (JP); Kiichiro Takahashi, Yokohama (JP); Toshiyuki Chikuma, Tokyo (JP); Hirokazu Yoshikawa, Yokohama (JP); Hiroshi Taira, Inagi (JP); Wakako Tanaka, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 102 days.

(21) Appl. No.: 13/647,639

(22) Filed: Oct. 9, 2012

(65) Prior Publication Data

US 2013/0135380 A1 May 30, 2013

Related U.S. Application Data

(63) Continuation of application No. PCT/JP2012/005087, filed on Aug. 9, 2012.

(30) Foreign Application Priority Data

Nov. 30, 2011 (JP) ..... 2011-262072

(51) Int. Cl.
*B41J 2/05* (2006.01)

(52) U.S. Cl.
USPC ..... 347/60; 347/17; 347/19

(58) Field of Classification Search
USPC ..... 347/19, 60, 17
See application file for complete search history.

(56) References Cited

U.S. PATENT DOCUMENTS

| | | | | |
|---|---|---|---|---|
| 5,559,535 | A | 9/1996 | Otsuka et al. | |
| 5,745,132 | A | 4/1998 | Hirabayashi et al. | |
| 5,940,094 | A | 8/1999 | Otsuka et al. | |
| 6,065,830 | A | 5/2000 | Hiramatsu et al. | |
| 6,234,599 | B1 | 5/2001 | Ishinaga et al. | |
| 6,283,650 | B1 * | 9/2001 | Yamada et al. | 400/120.14 |
| 6,331,039 | B1 | 12/2001 | Iwasaki et al. | |
| 6,394,571 | B1 | 5/2002 | Yano et al. | |

(Continued)

FOREIGN PATENT DOCUMENTS

| | | |
|---|---|---|
| EP | 0 353 925 A2 | 2/1990 |
| JP | 9-39253 A | 2/1997 |

(Continued)

OTHER PUBLICATIONS

International Search Report and Written Opinion dated Oct. 23, 2012, in International Application No. PCT/JP2012/005087.

*Primary Examiner* — Julian Huffman
(74) *Attorney, Agent, or Firm* — Fitzpatrick, Cella, Harper & Scinto

(57) ABSTRACT

In an ink jet printing apparatus including a plurality of print heads and a method for controlling the ink jet printing apparatus, ink ejection can be immediately started. If temperatures of both a first print head and a second print head have become equal to or higher than a reference temperature at least once, a printing operation or a preliminary ejection operation using the first print head and the second print head is started even when one of the temperature of the first print head and the temperature of the second print head is lower than the reference temperature.

7 Claims, 7 Drawing Sheets

(56) References Cited

U.S. PATENT DOCUMENTS

| | | | |
|---|---|---|---|
| 7,354,133 | B2 | 4/2008 | Ide et al. |
| 2008/0165217 | A1 | 7/2008 | Tanaka et al. |
| 2011/0085003 | A1 | 4/2011 | Oonuki et al. |
| 2011/0134185 | A1 | 6/2011 | Yamamoto et al. |

FOREIGN PATENT DOCUMENTS

| | | | |
|---|---|---|---|
| JP | 2001-225463 | A | 8/2001 |
| JP | 3900849 | B2 | 4/2007 |
| JP | 2008-188987 | A | 8/2008 |
| JP | 2011-121197 | A | 6/2011 |

* cited by examiner

INK JET PRINTING APPARATUS AND METHOD FOR CONTROLLING INK JET PRINTING APPARATUS

This application is a continuation of Application No. PCT/JP2012/005087, filed Aug. 9, 2012, which claims the benefit of Japanese Patent Application No. 2011-262072, filed Nov. 30, 2011, which are hereby incorporated by reference herein in their entirety.

BACKGROUND OF THE INVENTION

1. Field of the Invention

The present invention relates to an ink jet printing apparatus that prints an image by ejecting ink from a print head, and a method for controlling the ink jet printing apparatus.

2. Description of the Related Art

Some ink jet printing schemes of printing an image on a print medium by ejecting ink through a nozzle in accordance with an image signal use an electrothermal conversion element (heater) or a piezo element as an ejection energy generating element that allow ink to be ejected through the nozzle. A thermal ink jet scheme using the electrothermal conversion element applies an electric pulse to the electrothermal conversion element, which then generates heat to bubble ink, with the resulting bubbling energy utilized to eject the ink through the ejection port formed at the leading end of the nozzle. In such a thermal ink jet scheme, a change in environmental temperature or a change in the temperature of the print head associated with a printing operation may change the viscosity of the ink or the size of ink bubbles generated on the electrothermal conversion element. In such a case, the amount of ink ejected (the volume of the ink) and thus image printing density may be changed.

One method for preventing such a change in image printing density is a temperature rise control method of suppressing a change in the temperature of the print head by raising the temperature of the print head before starting printing. If such a temperature rise control method is applied to an ink jet printing apparatus with a plurality of print heads, the temperature of each of the print heads is raised to a reference value. However, when the print heads have different temperature rise characteristics or different temperatures before temperature rise, the print heads may reach the reference temperature at different timings. If a print head having reached the reference temperature first stops being heated and waits for the other print heads to reach the reference temperature, the temperature of the print head having reached the reference temperature first may decrease below the reference temperature during the wait. In this case, the print head with the temperature thereof having decreased below the reference temperature needs to be heated. It thus becomes difficult to quickly set the temperature of all the print heads equal to or higher than the reference temperature and then to start printing.

Japanese Patent No. 3900849 describes an ink jet printing apparatus in which a first reference temperature and a second reference temperature higher than the first reference temperature are set so that the apparatus raises the temperature of the print head until the print head reaches the second reference temperature and so that the apparatus starts printing when the print head exceeds the first reference temperature. The first reference temperature is a temperature at which the ink is ejected normally.

SUMMARY OF THE INVENTION

However, for example, in an irregular situation where the temperature of the print head is likely to become lower than expected, for example, when the environmental temperature is very low, it is difficult to quickly set the temperature of all the print heads equal to or higher than the reference temperature and then to start printing. This is because in such a situation, the temperature of a print head having reached the second reference temperature first may decrease below the first reference temperature before all the print heads exceed the first temperature. Furthermore, if the second reference temperature is set to be higher with such an irregular situation as described above assumed, the ink is prevented from being appropriately bubbled, possibly precluding normal ink ejection.

An object of the present invention is to provide an ink jet printing apparatus including a plurality of print heads and which controllably allows a printing operation to be immediately started.

An ink jet printing apparatus according to the present invention is characterized by comprising:

a first print head with a plurality of print elements configured to eject ink;

a first heating unit configured to heat the first print head;

a first temperature measuring unit configured to measure a temperature of the first print head;

a second print head with a plurality of print elements configured to eject ink;

a second heating unit configured to heat the second print head;

a second temperature measuring unit configured to measure a temperature of the second print head; and a control unit configured to control the first heating unit and the second heating unit in such a manner that the first print head and the second print head reach a reference temperature, wherein if both the first temperature measuring unit and the second temperature measuring unit at least once determine that temperatures of the respective print heads have become equal to or higher than the reference temperature, the control unit controllably starts a printing operation or a preliminary ejection operation using the first print head and the second print head even when a temperature measured by one of the first temperature measuring unit and the second temperature measuring unit is lower than the reference temperature.

The present invention provides an ink jet printing apparatus including a plurality of print heads and which controllably allows a printing operation to be immediately started.

Further features of the present invention will become apparent from the following description of exemplary embodiments (with reference to the attached drawings).

BRIEF DESCRIPTION OF THE DRAWINGS

FIG. 6 is similar to FIG. 2C.

DESCRIPTION OF THE EMBODIMENTS

Embodiments of the present invention will be described below with reference to the drawings.

(First Embodiment)

First, an example of configuration of an ink jet printing apparatus and a print head to which the present invention is applicable will be described with reference to FIG. 1 to FIG. 3.

Figure 1:
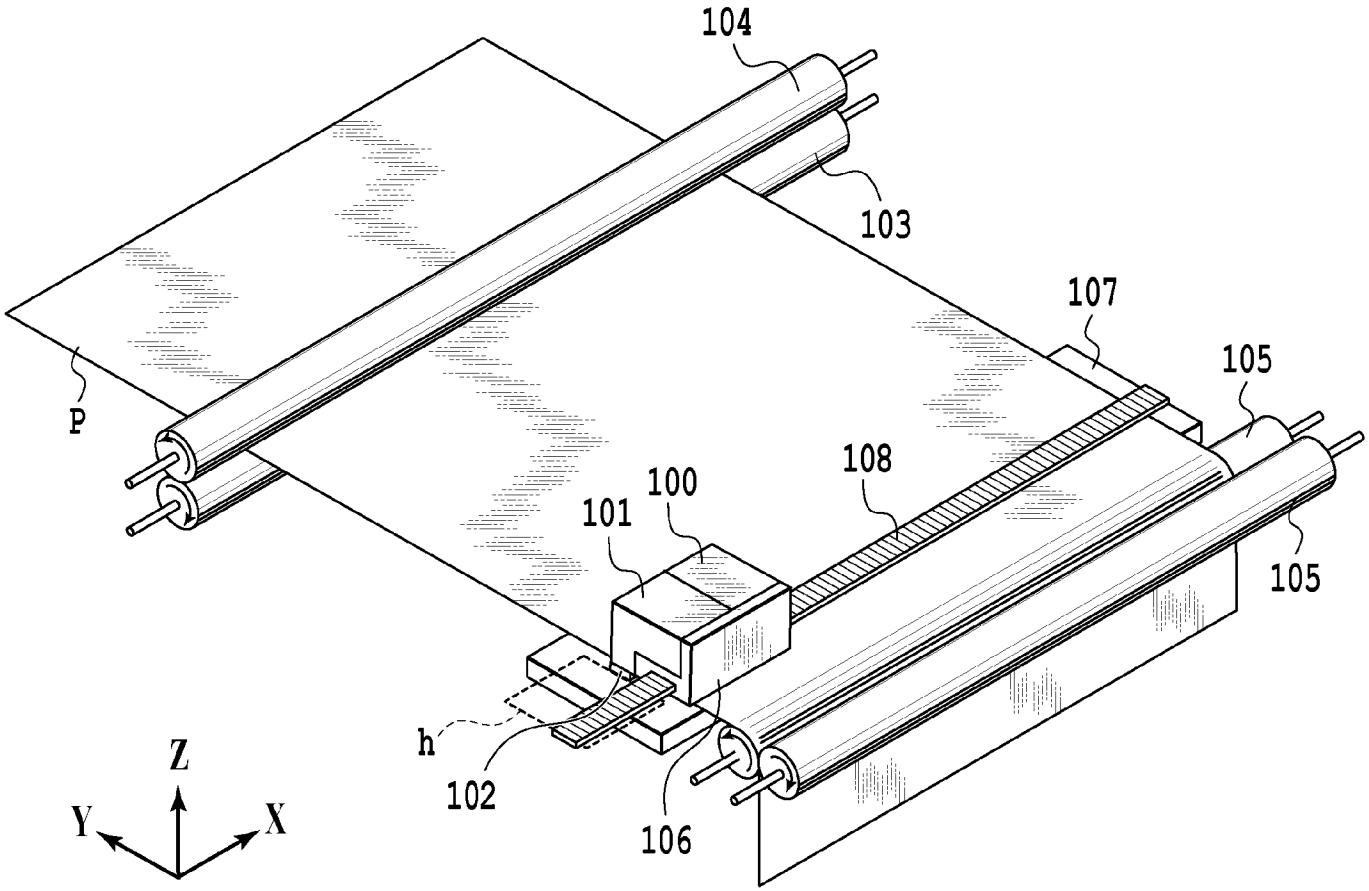
FIG. 1 is a perspective view of an essential part of an ink jet printing apparatus according to a first embodiment of the present invention.

FIG. 1 is a perspective view of an essential part of an ink jet printing apparatus. In the present example, a print head 100 (first print head) and a print head 101 (second print head) form an ink jet cartridge in which the print heads are integrated with respective ink tanks. However, the print heads are not limited to the configuration in which the print heads are integrated with the respective ink tanks as in the present example. The print heads may be separated from the ink tank. The ink tank integrated with the print head 100 accommodates three color inks, a black ink, a light cyan ink, and a light magenta ink, in the respective chambers. The ink tank integrated with the print head 101 accommodates three color inks, a cyan ink, a magenta ink, and a yellow ink, in the respective chambers. The print head 100 and the print head 101 are different only in the colors of the inks accommodated in the ink tank integrated with each print head, and have exactly the same print head configuration. Each of the heads 100 and 101 includes a head chip with a plurality of lines of ink ejection ports formed therein. A sheet feeding roller 103 rotates, together with an auxiliary roller 104, in the direction of an arrow in FIG. 1 while pressing a print medium P to convey a print medium P in a +Y direction (sub-scan direction). A sheet feeding roller 105 feeds the print medium P and also serves to press the print medium P similarly to the rollers 103 and 104. The print head 100 and the print head 101 are removably mounted on a carriage 106, which thus moves together with the print head 100 and the print head 101. While no printing is being performed or while a process of recovering the print head is being carried out, the carriage 106 stands by at a home position h shown by a dotted line in FIG. 1. A platen 107 serves to stably support the print medium P at a printing position. A carriage belt 108 is moved by a motor (not shown in the drawings) to move the carriage 106 in a ±X direction (main scan direction).

Figure 2C:
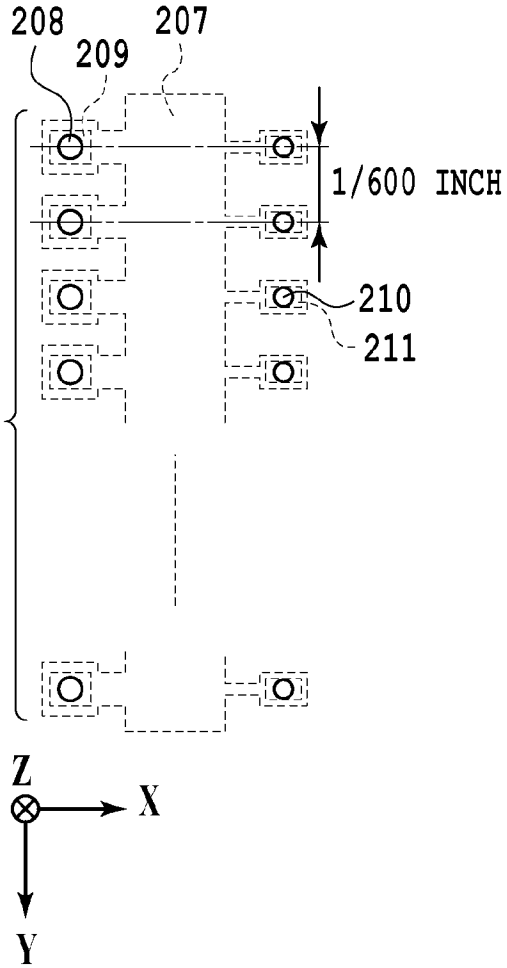
FIG. 2C is an enlarged view of ejection ports in the print head in FIG. 2B.
Figure 2B:
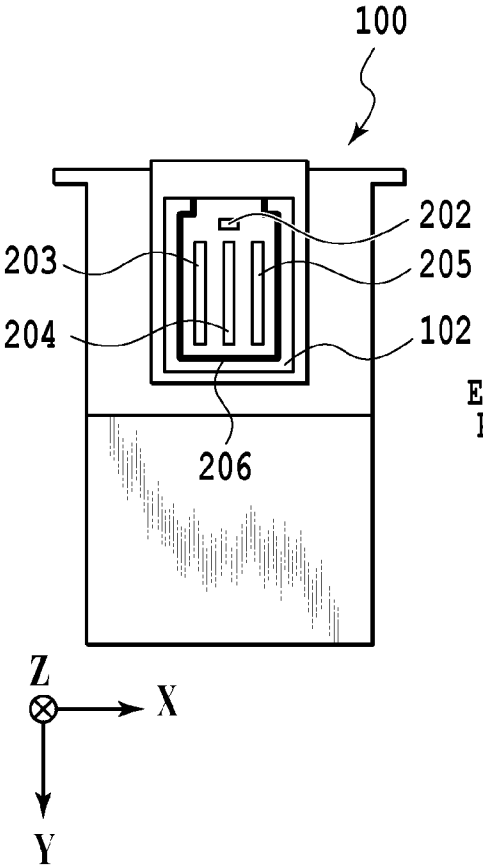
FIG. 2B is a plan view of the print head as seen in a Z direction.
Figure 2A:
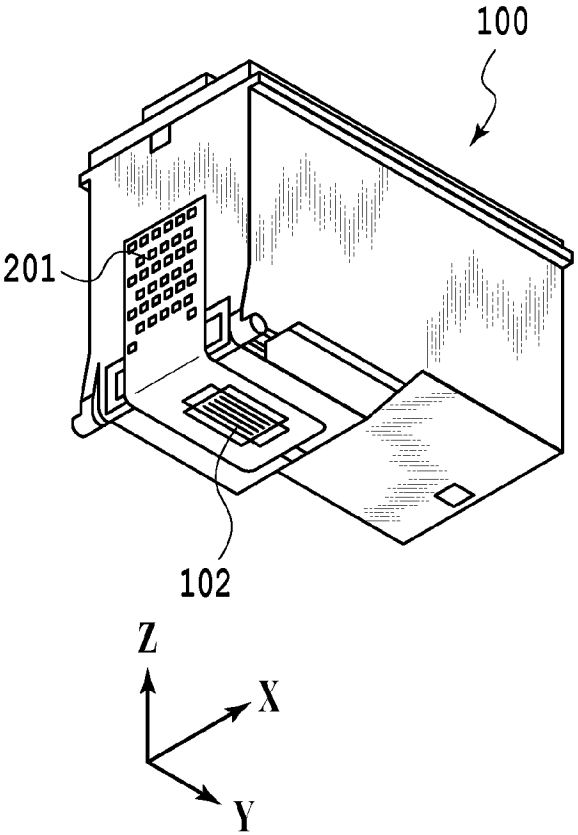
FIG. 2A is a perspective view of a print head in FIG. 1.

Since the print head 100 and the print head 101 have the same structure, the print head 100 will be representatively described below. FIG. 2A is a perspective view of the print head 100. FIG. 2B is a plan view of the print head 100 as seen in the Z direction. FIG. 2C is an enlarged view of ink ejection ports and surrounding areas thereof in FIG. 2.

In FIG. 2A, contact pads 201 receive a print signal and a drive voltage required to drive the print head, from a printing apparatus main body, and transmit the print signal and the drive signal to the head chip 102. In FIG. 2B, a diode sensor (hereinafter referred to as a sensor) 202 present in the head chip 102 detects the temperature of the print head 100. The present example uses the diode sensor as temperature detection means (temperature sensor) for the print head. However, the temperature detection means may be a metal thin film sensor or the like. The head chip 102 includes ejection port lines 203, 204, and 205 formed therein; the ejection port line 203 includes ejection ports arranged therein and through which the black ink is ejected, the ejection port line 204 includes ejection ports arranged therein and through which the cyan ink is ejected, and the ejection port line 205 includes ejection ports arranged therein and through which the magenta ink is ejected. The print head 101 has the same structure as that of the print head 100 except for the colors of the ejected inks.

An ink heating sub-heater 206 is formed so as to surround the ejection port lines 203, 204, and 205. The sub-heater 206 has a resistance value of 100Ω and generates heat to heat the ink upon receiving an applied drive voltage of 20 V. The temperature of the ink is adjusted by the switching control depending on whether or not the drive voltage is applied to the sub-heater 206.

FIG. 2C is an enlarged view representatively illustrating the ejection port line 204 for black ink ejection. An ejection port 208 through which 5 pl of ink is ejected and an ejection port 210 through which 2 pl of ink is ejected are formed on the respective opposite sides of an ink liquid chamber 207 to which black ink is supplied. A heater (electrothermal conversion element) 209 with a resistance value of 500Ω is arranged immediately below the ejection port 208 (on a +Z direction side). A heater (electrothermal conversion element) 211 with a resistance value of 700Ω is arranged immediately below the ejection port 210 (on the +Z direction side). Upon receiving an applied drive voltage of 20 V, both the heaters 209 and 211 generate heat to bubble the ink, and the resulting bubbling energy is utilized to eject the ink through the corresponding ejection ports 208 and 210.

In the present example, 600 ejection ports 208 and 600 ejection ports 211 are formed and arranged at intervals of 1/600 inch so as to provide a printing pixel density of 600 dpi. Furthermore, the heaters 209 and 211 have an ejection frequency of 24 kHz to allow ink droplets to be stably ejected. The carriage 106 with the print heads 100 and 101 mounted thereon moves at a speed of 20 inches/second (=24,000 (dots/second)÷1,200 (dots/inch)) in the main scan direction if ink droplets land on the print medium P at intervals of 1,200 dpi in the main scan direction. In the present example, the black ink, light cyan ink, light magenta ink, cyan ink, magenta ink, and yellow ink ejected by the print heads 100 and 101 all have the same ejection characteristics such as the amount and speed of ejection relative to temperature. For both the 5- and 2-pl ink droplets, an ejection speed of 15 m/s is the optimum condition for printing. The temperature of the ink which satisfies this condition is 50° C. An ink temperature of 30° C. is not suitable for printing because the ink ejection amount and speed are smaller than the optimum values at this temperature, but allows the ink to be reliably ejected. At an ink temperature of lower than 30° C., the ink is ejected at a reduced speed and may fail to land on the print medium, degrading printing quality. When the ink is at a low temperature of about 25° C., which is close to the room temperature, the ink is very viscous and may fail to be ejected. When the ink is at a high temperature of at least 80° C., an excessively large amount of ink is ejected and the ink supply may fail to be on time. As a result, the ink may be inappropriately ejected.

Figure 3:
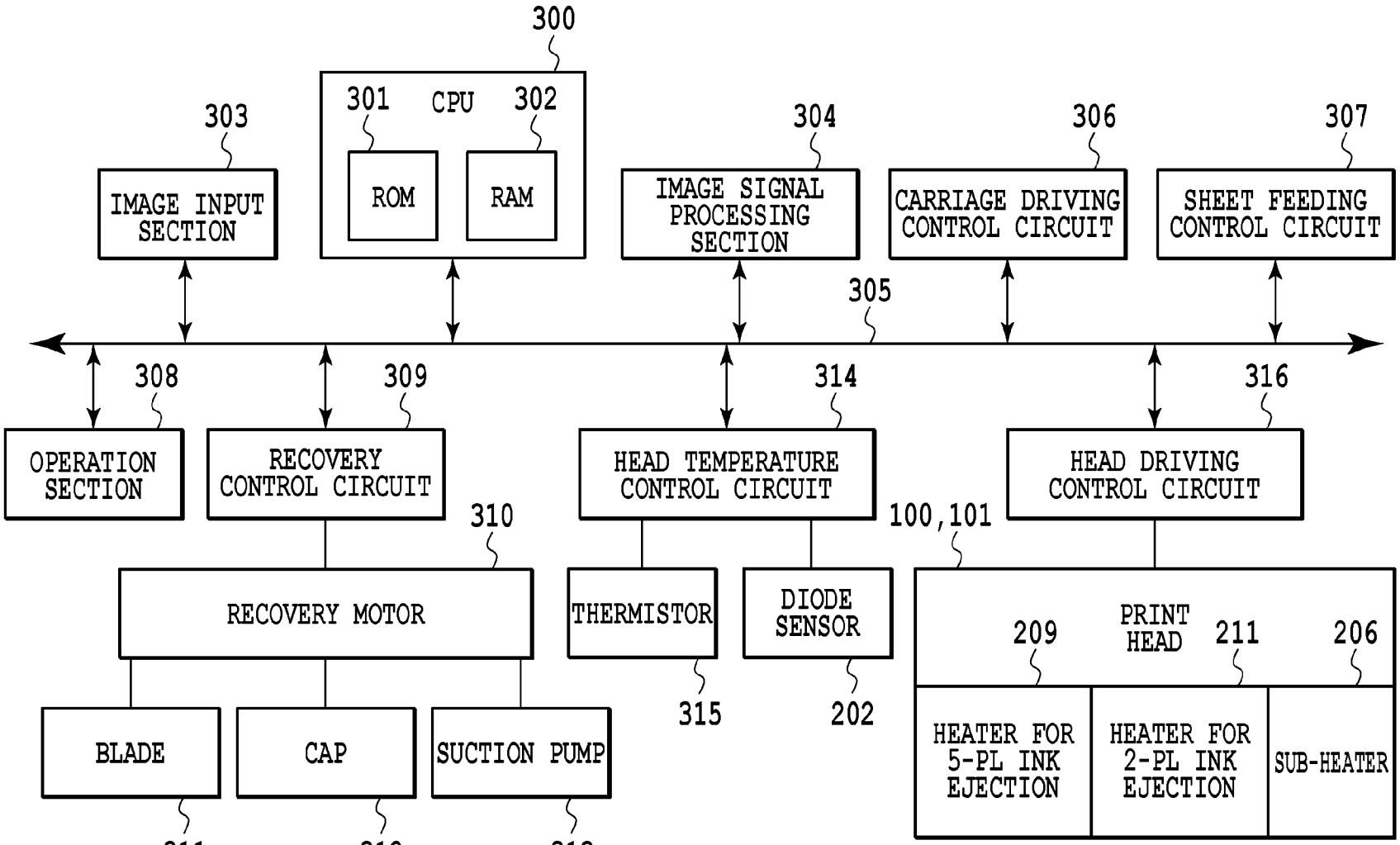
FIG. 3 is a block diagram of a control system in the ink jet printing apparatus in FIG. 1.

FIG. 3 is a block diagram of the control system in the ink jet printing apparatus in the present example.

The control system of the ink jet printing apparatus is roughly classified into software processing means and hardware processing means each of which accesses a main bus line 305. The software processing means includes an image input section 303, a corresponding image signal processing section 304, and a CPU 300 serving as a central control section. The hardware processing means include an operation section 308, a recovery control circuit 309, a head temperature control circuit 314, a head driving control circuit 316, a carriage driving control circuit 306, and a sheet feeding control circuit 307. The carriage driving control circuit 306 is configured to move the carriage 106 along the main scan direction. The sheet feeding control circuit 307 is configured to convey the print medium P in the sub-scan direction.

The CPU 300 is normally combined with a ROM 301 and a RAM 302 to drive the heaters 209 and the heaters 211 in the print head 100 and the print head 101, respectively, under appropriate printing conditions corresponding to the input information. A program for carrying out a process of recovering the print heads is pre-stored in the RAM 302. In accordance with the program, recovery process conditions such as preliminary ejection conditions are provided to the recovery control circuit 309, the print heads 100 and 101, and the like. A recovery motor 310 drives a blade 311 that wipes and cleans the print heads and an ejection port formation face of each print head, a cap 312 that caps the print heads, and a suction pump 313 that generates a negative pressure to be introduced into the cap.

The head temperature control circuit 314 determines drive conditions for the sub-heaters 206 in each of the print heads 100 and 101 based on output values from a thermistor 315 that detects the ambient temperature of the printing apparatus and the sensor 202 that detects the print head temperature. In accordance with the drive conditions, the head driving control circuit 316 drives the sub-heaters 206 to controllably raise the temperatures of the print heads 100 and 101. The head driving control circuit 316 drives not only the sub-heaters 206 but also heaters 209 and 211 that allow the print heads 100 and 101 to eject the ink, to control ejection of the ink for printing an image and preliminary ejection (ejection of an amount of the ink which does not contribute to image printing).

Figure 4:
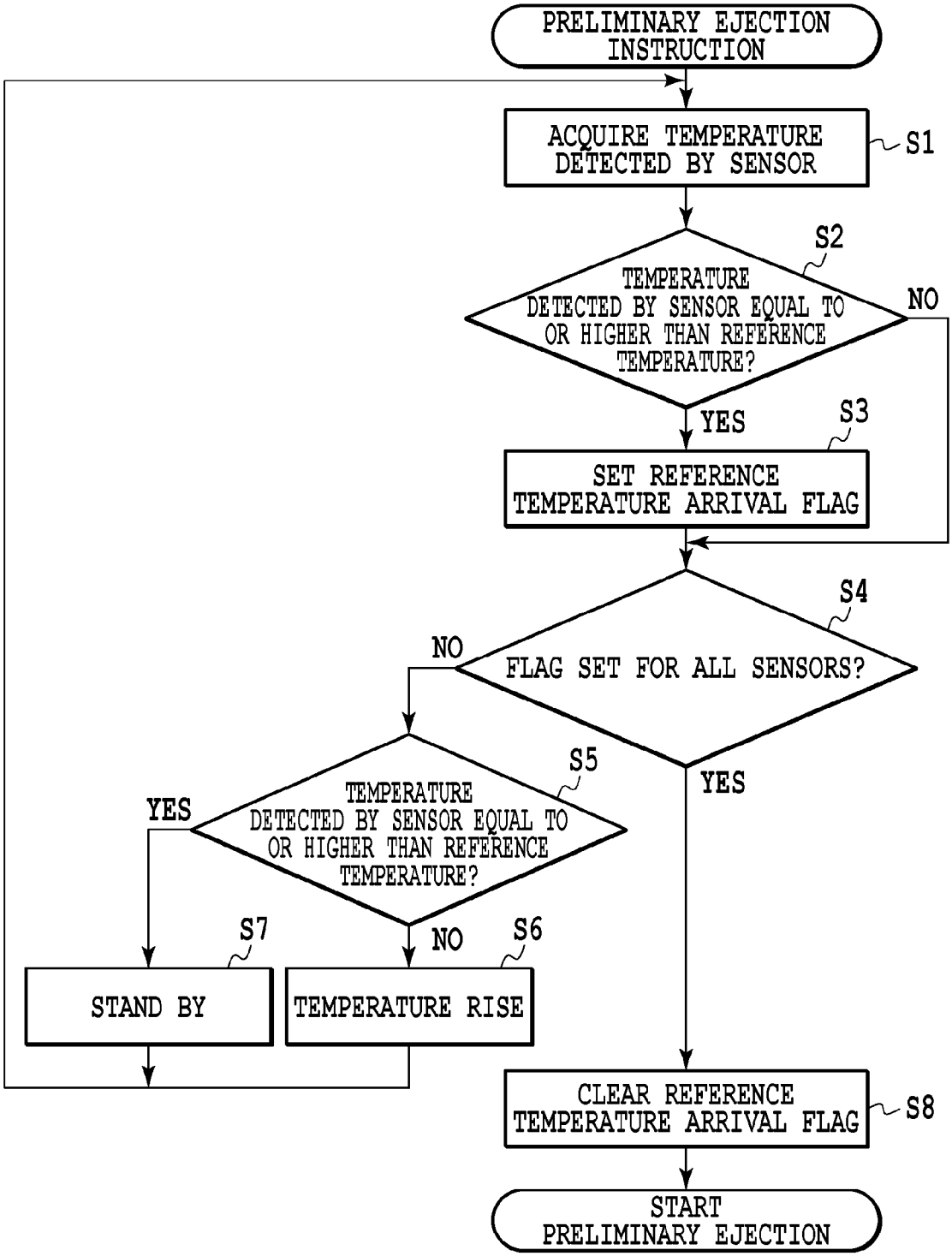
FIG. 4 is a flowchart illustrating temperature rise control in the ink jet printing apparatus in FIG. 3.

FIG. 4 is a flowchart illustrating the temperature rise control of the print head according to the present embodiment. In the present example, the temperature rise control raises the temperature of the print head to within a predetermined range of temperatures in order to allow an amount of the ink which does not contribute to image printing to be appropriately ejected (preliminary ejection).

When an instruction to carry out a preliminary ejection is given, first in step S1, the temperature detected by the sensor 202 in each of the print heads 100 and 101 is acquired. In the next step S2, the CPU determines whether or not the temperature detected by the sensor 202 in each of the print heads 100 and 101 is equal to or higher than a predetermined reference temperature that is a target temperature for temperature rise. If the temperature detected by the sensor 202 is equal to or higher than the reference temperature, a reference temperature arrival flag is set so as to allow determination of whether or not the temperature of the print head with the sensor 202 provided therein has become equal to or higher than the reference temperature (step S3). The flag is set for each of the sensors 202, and the sensor 202 with the flag set therefor allows determination of whether or not the temperature of one of the print heads 100 and 101 has become equal to or higher than the reference temperature. If the temperature detected by the sensor 202 is lower than the reference temperature, the process proceeds to step S4.

In step S4, the CPU determines whether or not the reference temperature arrive flag has been set for all the sensors 202. If the reference temperature arrive flag has not been set for all the sensors 202, the CPU determines in step S5 whether or not the temperature detected by each sensor 202 is equal to or higher than the reference temperature. When the temperature detected by each sensor 202 is not equal to or higher than the reference temperature, the temperature of the print head with the sensor 202 provided therein is raised (step S6). The process then returns to the previous step S1. Any method such as the following may be used to raise the temperature as long as the method allows the temperature of the print head to be increased: a method of allowing the sub-heaters 206 for heating to generate heat and a method of applying a short pulse to the heaters 209 and 210 to allow the heaters 209 and 210 to generate heat to the degree that the ink is not ejected. When the temperature detected by the sensor 202 is equal to or higher than the reference temperature, the print head with the sensor 202 provided therein is allowed to stand by (step S7). The process then returns to step S1. No control for temperature adjustment is performed on the standing-by print head.

If the reference temperature arrive flag has been set for all the sensors 202, then in step S8, the reference temperature arrive flag is cleared for all the sensors 202 and then the preliminary ejection is started. Thus, if the temperatures of all the print heads mounted on the carriage have become equal to or higher than the reference temperature, then during the standby in step S7, the preliminary ejection is immediately started even if the temperature of any of the print heads has decreased below the reference temperature.

Figure 5:
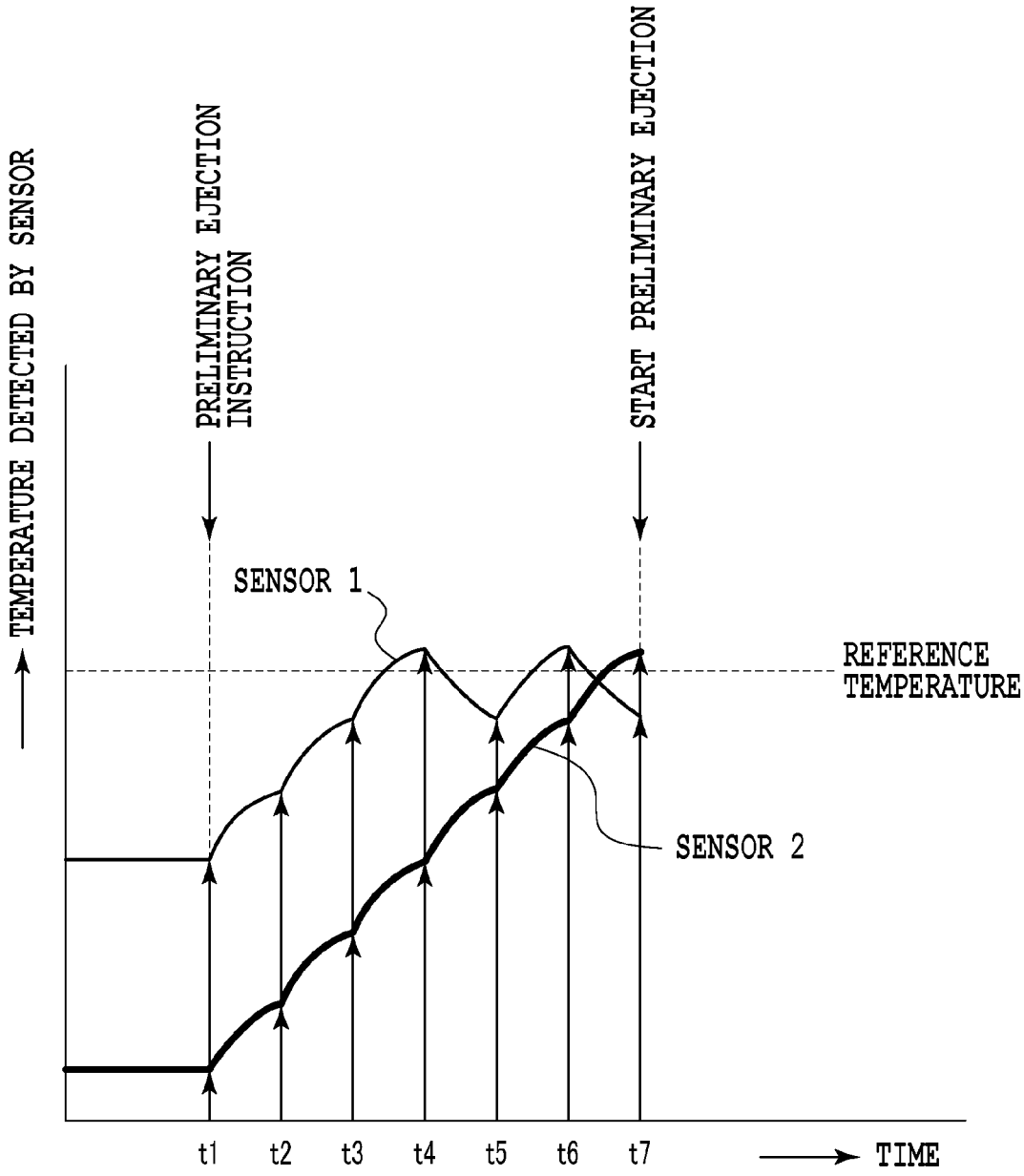
FIG. 5 is a diagram illustrating a variation in a temperature detected by a temperature sensor according to the first embodiment of the present invention.

FIG. 5 is a diagram illustrating a variation in the temperature detected by the sensor 202 according to the present embodiment. For convenience of description, the sensor 202 provided in the print head 100 is referred to as a sensor 1. The sensor 202 provided in the print head 101 is referred to as a sensor 2. In FIG. 5, the axis of abscissa indicates time, and the axis of ordinate indicates the temperatures detected by the sensors 1 and 2, respectively. In FIG. 5, "t1" to "t7" are timings for the determination of the detected temperature in step S5 in FIG. 4.

At a point of time t1, neither of the temperatures detected by the sensors 1 and 2 is equal to or higher than the reference temperature (the temperatures are lower than the reference temperature). Thus, the reference temperature arrival flag is not set for the sensors 1 and 2 (steps S2 and S4), and the temperatures of both the print heads 100 and 101 are raised (steps S5 and S6). Similarly, at points of time t2 and t3, the temperatures of both the print heads 100 and 101 are raised.

At a point of time t4, only the temperature detected by the sensor 1 becomes equal to or higher than the reference temperature. Thus, the reference temperature arrival flag is set only for the sensor 1 (steps S2 and S3). The print head 100 stands by (step S7). The temperature detected by the sensor 2 is lower than the reference temperature, and the reference temperature arrival flag is not set for the sensor 2 (steps S2 and S4). Thus, the temperature of the print head 101 is kept being raised (steps S5 and S6).

At a point of time t5, the temperature of the print head 100 decreases, and the both the temperatures detected by the sensors 1 and 2 are lower than the reference temperature. Thus, the temperatures of both the print heads 100 and 101 are raised (step S6). However, the reference temperature arrival flag has already set for the sensor 1 at the point of time t4.

At a point of time t6, as in the case of the point of time t4, only the temperature detected by the sensor 1 is equal to or higher than the reference temperature. Thus, the reference temperature arrival flag already set for the sensor 1 is set again, and the print head 101 stands by (step S7). The temperature of the print head 101 continues to be raised (step S6).

At a point of time t7, the temperature detected by the sensor 1 decreases, and only the temperature detected by the sensor 2 is equal to or higher than the reference temperature, and thus the reference temperature arrival flag is set for the sensor 2 (steps S2 and S3). The reference temperature arrival flag has already been set for the sensor 1. Hence, the reference temperature arrival flag has been set for both the sensors 1 and 2. Therefore, after the reference temperature arrival flags set for the sensors 1 and 2 are cleared (step S8), ejection of the ink from the print heads 100 and 101 may be accepted to immediately start carrying out the preliminary ejection on the print heads 100 and 101.

Thus, the reference temperature arrival flag is set for each of the temperature sensors (sensors 202) provided in the respective print heads when the temperature detected by the sensor has at least once become equal to or higher than the reference temperature. When the reference temperature arrival flag is set for all the temperature sensors, the preliminary ejection is carried out on the plurality of print heads with the respective temperature sensors provided therein. Thus, if the temperatures of all the print heads become equal to or higher than the reference temperature and the reference temperature arrival flag is set for all the temperature sensors, the preliminary ejection operation can be started even if the temperature of any print head is lower than the reference temperature. For the print head with a temperature lower than the reference temperature, the temperature of the print head is controllably raised so as to reach the reference temperature regardless of whether or not the temperature of the print head has at least once become equal to or higher than the reference temperature. As a result, the temperature of the print head can be appropriately controlled so as to remain as close to the reference temperature as possible.

The present example describes the temperature rise control for raising the temperature of the print head before the preliminary ejection for maintaining the appropriate ejection conditions for the print head. High-quality images can be printed by carrying out the preliminary ejection before starting a printing operation. Furthermore, the purpose of the temperature rise control is not limited to an increase in the temperature of the print head intended to allow the ink to be preliminarily ejected before a printing operation. The temperature rise control in the present example can be preformed when the ink is ejected for various purposes, for example, before the ink is ejected to print an image. The temperature of the print head can be appropriately raised to allow an image printing operation to be immediately started by carrying out the temperature rise control according to the present example before the printing operation.

Furthermore, the present example describes the use of the two print heads. However, at least three print heads may be similarly controlled.

(Second Embodiment)

According to the present embodiment, one print head includes three temperature sensors, and temperature rise control is performed on the print head before a preliminary ejection for recovering the print head is carried out. Components similar to those of the above-described embodiment are denoted by the same reference numerals and will not be described in detail.

Figure 6:
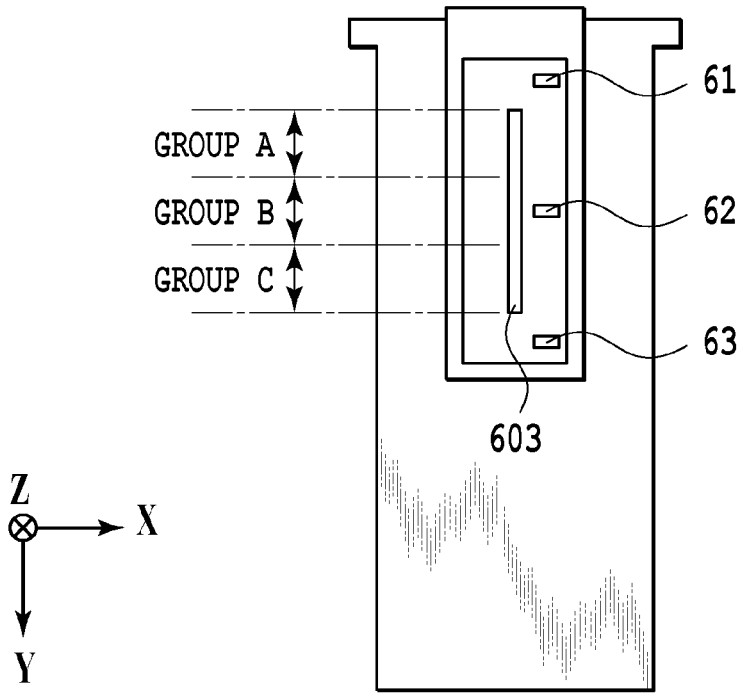
FIG. 6 is an enlarged view of a print head according to a second embodiment of the present invention.

FIG. 6 is a plan view of the print head according to the present embodiment as seen in a −Z direction. The print head in the present example includes a diode sensor 61 that detects the temperature of the upper portion of the print head, a diode sensor 62 that senses the temperature of the middle portion of the print head, and a diode sensor 63 that detects the temperature of the lower portion of the print head. During temperature rise control, an ejection port line 603 is divided into a group A, a group B, and a group C corresponding to the upper position, middle portion, and lower portion of the print head. A short pulse that is insufficient to allow the ink to be ejected is applied to the heaters positioned in each of the groups. That is, according to the temperature detected by the sensor 61, the heaters positioned in the group A are allowed to generate heat to raise the temperature of the upper portion of the print head. Similarly, according to the temperature detected by the sensor 62, the heaters positioned in the group B are allowed to generate heat to raise the temperature of the middle portion of the print head. According to the temperature detected by the sensor 63, the heaters positioned in the group C are allowed to generate heat to raise the temperature of the lower portion of the print head. The groups A, B, and C need not be even. The upper portion, middle portion, and lower portion of the print head in which the groups A, B, and C, respectively, are positioned have different temperature rise characteristics due to different radiation characteristics and the like. Thus, the ejection port line maybe divided into the groups A, B, and C according to the temperature rise characteristics.

Figure 7:
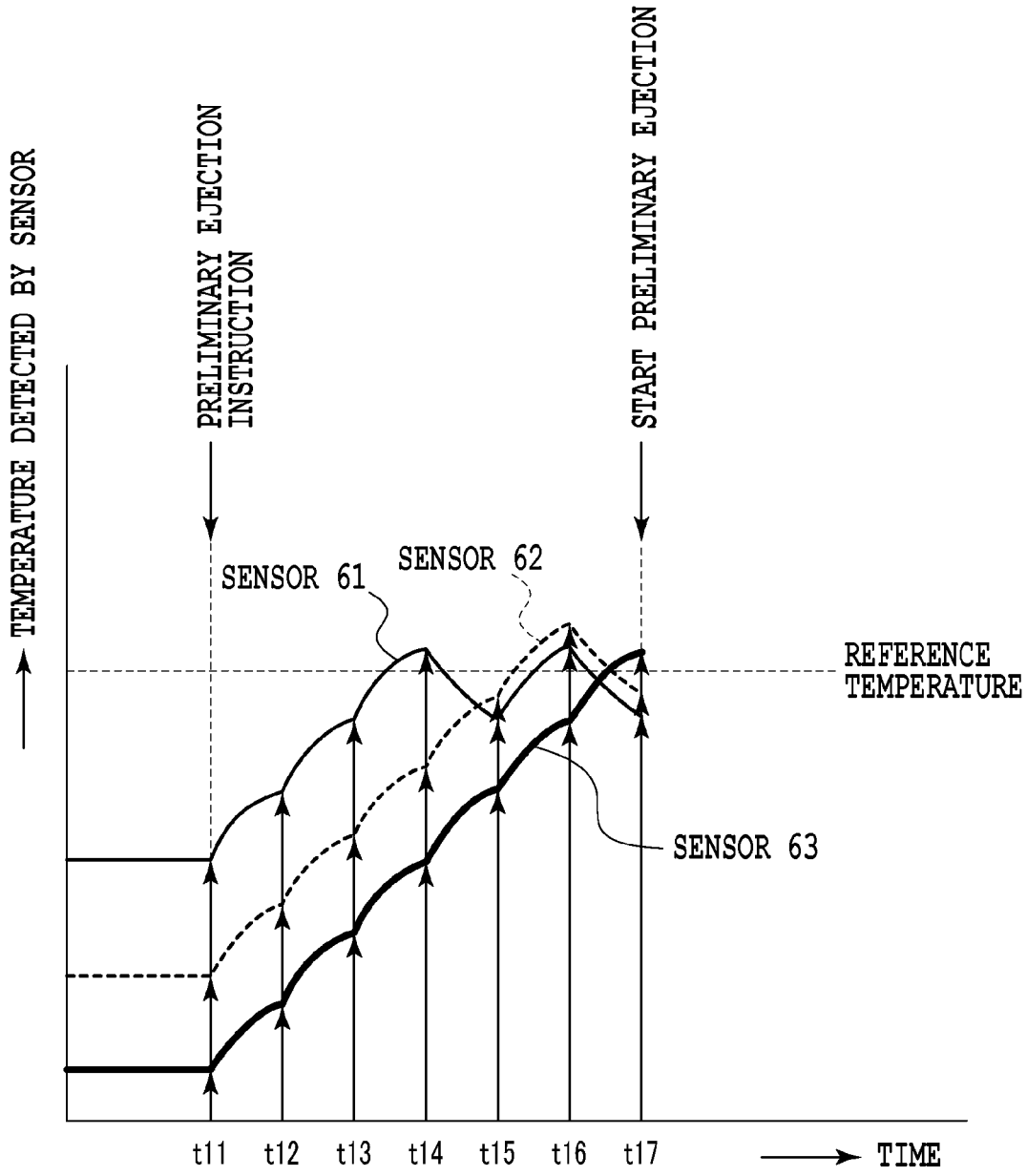
FIG. 7 is a diagram illustrating a variation in a temperature detected by a temperature sensor according to the second embodiment of the present invention.

FIG. 7 is a diagram illustrating variations in the temperatures detected by the sensors 61, 62, and 63 according to the present embodiment. In FIG. 7, "t11" to "t17" denote timings at which the detected temperature is judged in step S5 described above with reference to FIG. 4.

At a point of time t11, none of the temperatures detected by the sensors 61, 62, and 63 is equal to or higher than the reference temperature, and thus the reference temperature arrival flag is not set for the sensors 61, 62, and 63 (steps S2 and S4). The temperatures for the groups A to C in the print head are all raised (steps S5 and S6). Similarly, at points of time t12 and t13, the temperatures for the groups A to C in the print head are all raised.

At a point of time t14, only the temperature detected by the sensor 61 is equal to or higher than the reference temperature, and thus the reference temperature arrival flag is set for the sensor 61 (steps S2 and S3). The portion of the print head corresponding to the group A stands by (step S7). The temperatures detected by the sensors 62 and 63 are not equal to or higher than the reference temperature, and thus the reference temperature arrival flag is not set for the sensors 62 and 63 (steps S2 and S4). The temperatures of the portions of the print head corresponding to the groups B and C, respectively, continue to be raised (steps S5 and S6).

At a point of time t15, the temperature of the portion of the print head corresponding to the group A decreases, and none of the temperatures detected by the sensors 61, 62, and 63 is equal to or higher than the reference temperature, and thus the temperature of portions of the print head corresponding to the groups A, B, and C are all raised (step S6). However, the reference temperature arrival flag has already been set for the sensor 61 at the point of time t14.

At a point of time t16, the temperatures detected by the sensors 61 and 62 are equal to or higher than the reference temperature. Thus, the reference temperature arrival flag already set for the sensor 61 is set again, and the reference temperature arrival flag is set for the sensor 62 for the first time. Consequently, the groups A and B in the print head stand by (step S7). The temperature of the portion of the print head corresponding to the group C continues to be raised (step S6).

At a point of time t17, the temperatures detected by the sensors 61 and 62 decrease, and only the temperature detected by the sensor 63 is equal to or higher than the reference temperature, and thus the reference temperature arrival flag is set for the sensor 63 (steps S2 and S3). The reference temperature arrival flag has already been set for the sensors 61 and 62. Hence, the reference temperature arrival flag has been set for all of the sensors 61, 62, and 63. Therefore, after the reference temperature arrival flags set for the sensors 61, 62, and 63 are cleared (step S8), a preliminary ejection of the ink through the groups A, B, C in the print head may start to be carried out.

As described above, even if one print head includes a plurality of temperature sensors (sensors 61, 62, and 63), the temperature of the print head can be appropriately controlled to immediately start a preliminary ejection or a printing operation. Means for raising the temperature of the print head (temperature raising means) is not limited to the method of applying a short pulse to the heaters to allow the heaters to generate heat as in the present example. Various schemes may be used as the temperature raising means; for example, heaters provided around the temperature sensor maybe used to generate heat.

(Other Embodiments)

Besides the above-described electrothermal conversion elements (heaters), various elements such as piezo elements maybe used as ejection energy generating elements for the print head. Furthermore, the image printing scheme is not limited to the above-described serial scan scheme of printing an image by moving the print head in the main scan direction while conveying the print medium in the sub-scan direction intersecting with the main scan direction. For example, a full line scheme may be used which uses a long print head extending over the entire width of the print area of the print medium to print an image while continuously conveying the print medium.

The plurality of temperature sensors and the plurality of temperature raising means are not limited to a one-to-one relationship but may have a many-to-one relationship. That is, the plurality of temperature sensors may be associated with the plurality of temperature raising means. Furthermore, if a plurality of print heads are used, a plurality of temperature sensors and a plurality of temperature raising means may be provided for each of the print heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet printing apparatus comprising:

a receiving unit configured to receive an instruction to start a printing operation or a preliminary ejection operation;

a first print head with a plurality of print elements configured to eject ink;

a first heating unit configured to heat the first print head;

a first temperature measuring unit configured to measure a temperature of the first print head;

a second print head with a plurality of print elements configured to eject ink;

a second heating unit configured to heat the second print head;

a second temperature measuring unit configured to measure a temperature of the second print head; and a control unit configured to control the first heating unit and the second heating unit in such a manner that the first print head and the second print head reach a reference temperature, wherein if both the first temperature measuring unit and the second temperature measuring unit at least once measure that temperatures of the respective print heads have become equal to or higher than the reference temperature after the receiving unit receives the instruction, the control unit controllably starts the printing operation or the preliminary ejection operation using the first print head and the second print head when one of a temperature measured by the first temperature measuring unit and a temperature measured by the second temperature measuring unit is lower than the reference temperature at the start of the printing operation or the preliminary ejection operation.

2. The ink jet printing apparatus according to claim 1, wherein the first heating unit is a resistor provided so as to surround the plurality of print elements of the first print head, and the second heating unit is a resistor provided so as to surround the plurality of print elements of the second print head.

3. The ink jet printing apparatus according to claim 1, further comprising a scanning unit in which the first print head and the second print head are mounted and which reciprocates with respect to a print medium.

4. The ink jet printing apparatus according to claim 1, wherein the first temperature measuring unit and the second temperature measuring unit are diode sensors.

5. The ink jet printing apparatus according to claim 1, wherein each of the first temperature measuring unit and the second temperature measuring unit comprises a plurality of temperature sensors.

6. An ink jet printing apparatus comprising:

a receiving unit configured to receive an instruction to start a printing operation or a preliminary ejection operation;

a first print head with a plurality of electrothermal conversion elements configured to eject ink;

a first temperature measuring unit configured to measure a temperature of the first print head;

a second print head with a plurality of electrothermal conversion elements configured to eject ink;

a second temperature measuring unit configured to measure a temperature of the second print head; and a control unit configured to control the plurality of electrothermal conversion elements in the first print head and the plurality of electrothermal conversion elements in the second print head in such a manner that temperatures of the first print head and the second print head reach a reference temperature, wherein if both the first temperature measuring unit and the second temperature measuring unit at least once measure that temperatures of the respective print heads have become equal to or higher than the reference temperature after the receiving unit receives the instruction, the control unit controllably starts the printing operation or the preliminary ejection operation using the first print head and the second print head when one of a temperature measured by the first temperature measuring unit and a temperature measured by the second temperature measuring unit is lower than the reference temperature at the start of the printing operation or the preliminary ejection operation.

7. A method for controlling an ink jet printing apparatus comprising a first print head with a plurality of print elements configured to eject ink and a second print head with a plurality of print elements configured to eject ink, the method comprising steps of:

receiving an instruction to start a printing operation or a preliminary ejection operation;

measuring a temperature of the first print head and a temperature of the second print head;

heating the first print head and the second print head in such a manner that temperatures of the first print head and the second print head reach a reference temperature; and starting the printing operation or the preliminary ejection operation using the first print head and the second print head if temperatures of both the first print head and the second print head have become equal to or higher than the reference temperature at least once after receiving the instruction, when one of the measured temperature of the first print head and the measured temperature of the second print head is lower than the reference temperature at the start of the printing operation or the preliminary ejection operation.

* * * * *